US011187046B2

(12) United States Patent
Schrinner et al.

(10) Patent No.: US 11,187,046 B2
(45) Date of Patent: Nov. 30, 2021

(54) GROUND DRILLING DEVICE AND METHOD FOR DRILLING IN SOIL

(71) Applicant: TRACTO-TECHNIK GmbH & Co. KG, Lennestadt (DE)

(72) Inventors: Rene Schrinner, Eslohe (DE); Stefan Hermes, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 16/783,880

(22) Filed: Feb. 6, 2020

(65) Prior Publication Data

US 2020/0263505 A1 Aug. 20, 2020

(30) Foreign Application Priority Data

Feb. 20, 2019 (DE) ..... 10 2019 001 204.6

(51) Int. Cl.
*E21B 17/02* (2006.01)
*E21B 17/042* (2006.01)

(52) U.S. Cl.
CPC ..... *E21B 17/021* (2013.01); *E21B 17/042* (2013.01)

(58) Field of Classification Search
CPC ..... E21B 17/021; E21B 17/042; E21B 7/00
See application file for complete search history.

(56) References Cited

U.S. PATENT DOCUMENTS

| | | | | |
|---|---|---|---|---|
| 5,289,887 | A | 3/1994 | Puttmann | |
| 5,431,234 | A | 7/1995 | Klemm | |
| 2016/0002989 | A1* | 1/2016 | Lane | E21B 7/046 175/24 |
| 2018/0216423 | A1* | 8/2018 | Henriksen | E21B 19/168 |

FOREIGN PATENT DOCUMENTS

| | | | |
|---|---|---|---|
| DE | 288 303 | A7 | 3/1991 |
| DE | 4103196 | A1 | 8/1992 |
| DE | 4113422 | A1 | 10/1992 |
| DE | 296 10 316 | U1 | 9/1996 |
| DE | 19917538 | * | 10/2000 |
| DE | 19917538 | A1 | 10/2000 |
| EP | 0190669 | A2 | 8/1986 |

* cited by examiner

*Primary Examiner* — Kristyn A Hall
(74) *Attorney, Agent, or Firm* — Howard IP Law Group, PC

(57) ABSTRACT

A ground drilling device for drilling in soil by means of a drill string, wherein the ground drilling device comprises a drilling carriage and a sled movable in translation on the drilling carriage, and on the sled there is arranged a holder a) for the screwed connection of a rod section to the drill string, or b) for the screwed detachment of a rod section from the drill string, wherein the holder can move in translation relative to the sled in order to compensate for a change in the position of the holder caused by the screwing process.

16 Claims, 2 Drawing Sheets

GROUND DRILLING DEVICE AND METHOD FOR DRILLING IN SOIL

Figure 1:
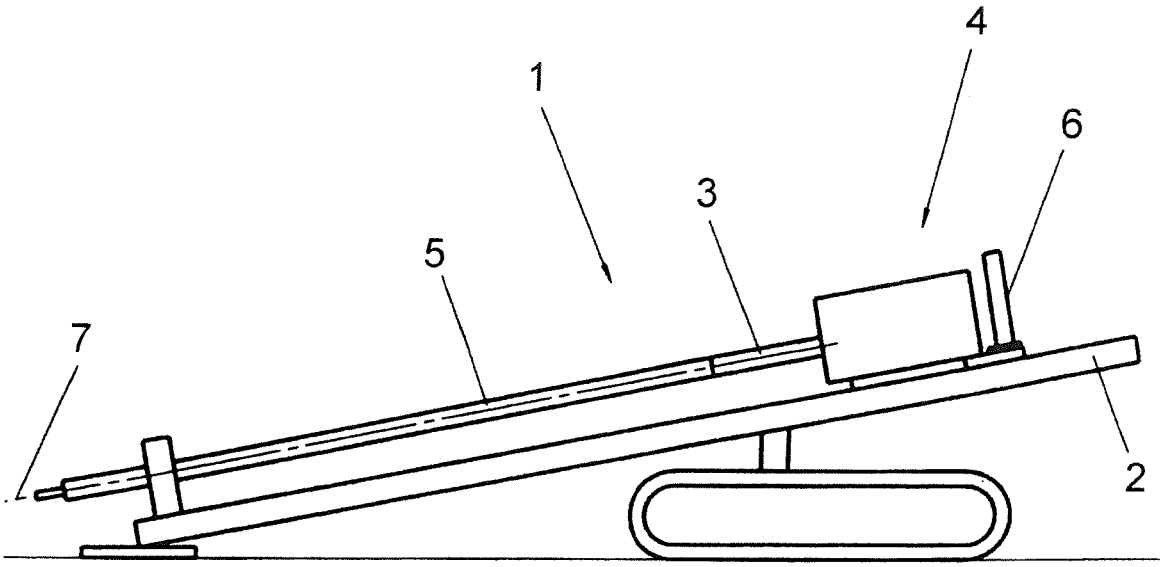

The invention relates to a ground drilling device for drilling in soil by means of a drill string and a method for drilling in soil by means of a drill string.

Ground drilling devices, particularly horizontal drilling devices, are used to introduce earth boreholes into the soil in trenchless methods, for example for supply and disposal conduits, or to replace old lines already laid in a trenchless method. To make the earth boreholes, a drill string comprising drill rod sections is usually employed, in which the drill rod sections can be connected to each other.

For example, there is known from EP 0 886 034 B1 how to use a sled moving back and forth in a frame in order to push and/or pull a drill string. The sled comprises a holder for a drill rod section, so that the drill rod section can be moved in the holder in the direction of an axis of advancement to create the earth borehole. The drive unit acting on the drill rod section can act on the drill rod section in the holder in rotary and/or translatory manner.

When replacing the drill string or lengthening a drill string, the holder is usually detached from the drill string already introduced into the soil and the sled is moved contrary to the direction of advancement and a new drill rod section which is to be connected to the already introduced drill string is introduced into the holder of the sled. The sled is then moved in the direction of advancement and the drill rod section is connected, in particular screwed, to the already introduced drill string. For this, threads are arranged at the ends of the drill rod sections, serving for the screwing on of the drill rod sections. In order to screw on a drill rod section, it is customary to "disengage" the sled such that the sled can move during the forming of the connection of the holder to the rod section and the connecting of the rod section to the introduced drill string. Accordingly, the sled moves in the direction of the drill string basically by the length dictated by the screwing process or processes. Two screwing processes should be considered. On the one hand, the screwing of the new rod section to the drill string, as well as the screwing of the holder to the new rod section. Once the screwing process is finished, a movement of the sled by means of the drive should only be performed with caution, particularly until the distance due to the screwing processes has been compensated. Only then can the drilling be resumed with larger advancing force and higher speed.

The drawback is therefore that the sled must be brought up each time for an additional drill rod section when lengthening the drill string and the time to produce the earth borehole is increased.

Therefore, the problem which the invention proposes to solve is to create an improved ground drilling device and a method for drilling in the soil with which an improved making of an earth borehole is possible, particularly a faster making of an earth borehole.

The problem is solved by the objects of the coordinated patent claims. Advantageous embodiments are the subject matter of the respective dependent patent claims and will emerge from the following specification. The key idea of the invention is to design a holder for a rod section, which is to be connected by screwing to the already introduced drill string, so that it is movable with respect to the sled. Thanks to the movability of the holder relative to the sled, particularly in the direction of the drill string or away from it, it is possible to compensate for a change in position of the holder in relation to the rod section being screwed on or removed that is caused by the screwing process. It must also be taken into account that the position of the rod section being added changes during its connecting to the drill string and the holder. The sled itself may be stationary—even though the holder is moved to compensate for the change in position due to the screwing process—and in particular it remains in direct force locking with the drive which is driving the sled. Thus, the drilling process can be resumed immediately after the screwing process. A careful moving up of the sled after the lengthening of the drill string by means of a rod section screwed to the already introduced drill string can be decreased or eliminated entirely.

The inventors have broken with the notion that the holder must be rigid to the sled. Providing a relative movement between the holder and the sled was contrary to the formerly held belief that a massive, unchangeable or firm connection between the holder and the sled had to be present in order to transmit the necessary large forces applied to the drill string.

The invention creates a ground drilling device for drilling in soil by means of a drill string, wherein the ground drilling device comprises a drilling carriage and a sled movable in translation on the drilling carriage. On the sled there is arranged a holder. The holder is adapted for the screwed connection of a rod section to the drill string or for the screwed detachment of a rod section from the drill string. The holder can move in translation relative to the sled in order to compensate for a change in the position of the holder caused by the screwing process.

The term "ground drilling device" encompasses in the sense of the specification any device which moves in particular a drill string having rod sections in an existing or yet to be created conduit in the soil, in order to create or widen a borehole, particularly a horizontal borehole, or to draw pipelines or other long bodies into the soil. A ground drilling device may comprise a driving device pushing and/or pulling and driving forward a drill string. In addition or alternatively, it may be provided that the driving device drives the drill string in rotation. A ground drilling device may be a device for advancement of a drill string that works in particular by displacement of soil.

The term "horizontal borehole" (horizontal drilling) in the sense of the present specification encompasses in particular every kind of existing or yet to be created conduit in a body, preferably running horizontally for at least a portion, particularly soil conduits including earth boreholes, rock boreholes or ground channels, as well as underground or aboveground pipelines and water channels that can be produced or pulled in by use of a corresponding ground drilling device.

The term "drill string" in the sense of the specification encompasses any means which can be introduced into the soil in order to make a borehole in the soil. In particular, the drill string may comprise a rod, a chain, and/or a cable. The term "drill string" encompasses in the sense of the specification not only rigid, individual drill strings having rod sections connected directly or indirectly to each other, but also in particular any force transmitting elements which can be used in a ground drilling device. Moreover, the drill string may comprise at one end, particularly the front end, a drilling head and optionally a drilling head tip or a region adjacent to the drilling head, which may be designed as a drilling tool or comprise such a tool.

The term "drilling carriage" encompasses a frame, particularly a movable frame, on which a sled can be provided for moving the drill string, which can move back and forth in the direction of the drill string axis in order to move the drill string in the soil by pushing or pulling. The sled may be moved relative to the drilling carriage by the use of a linear drive. Moreover, the drilling carriage can comprise one or more clamping devices, by which the drill string or a rod section being attached can be secured. It may be provided that a clamping device is provided on the drilling carriage, by means of which the free end of the drill string (the end protruding out from the ground) can be secured, in order to make possible a connecting of a newly attached rod section to the already introduced drill string.

A holder is provided on the sled, which can receive a rod section being added or removed, particularly at the end, in such a way that the holder secures the rod section with force locking and/or form fitting, in order to drive the rod section in particular by turning about its longitudinal axis. The holder can be designed, for example, such that the holder engages at its end with a rod section being added or removed and creates a form fitting. When the holder is turned, the rod section taken up by the holder can also be turned.

The term "position" of the holder or a rod section in the sense of the invention encompasses in particular the position of the holder or the rod section as dictated by its travel along the drilling carriage, wherein the position may change in particular in that the rod section situated in the holder can be screwed together with the drill string and the holder or unscrewed from them. Basically, a change in position is thus a translatory movement of the holder along the drill string axis. The change in position of the holder relative to the rod section being screwed on or removed corresponds to the change in position of the holder relative to the introduced drill string.

In one preferred embodiment, a carrier supporting the holder is movably arranged on the sled and can be secured on the sled. The sled may thus comprise a base, relative to which the carrier can move. By means of the carrier, which carries the holder, a selective securing to the sled/base or a selective securing relative to the sled/base can be accomplished. If the carrier is secured relative to the sled/base, the sled/base and the carrier can move together. If the securing between carrier and sled is loosened, a relative movement between the carrier and the sled may occur, with the result that the holder supported by the carrier can move relative to the sled. While the sled remains in force locking with the drive actuating the sled, the holder can be moved with the carrier. The direction in which the carrier can move relative to the sled is oriented substantially in the direction of the drill string or offset in parallel from it.

In one preferred embodiment, the carrier can be secured on the sled or relative to a base of the sled by means of a bolt, particularly one that is hydraulically activated. In this way, a particularly simple design can be achieved. A bolt on the carrier or the sled/base can travel into a corresponding recess in the other of the two elements of carrier and sled. In particular, a form fit can be produced between the carrier and the sled, this form fit acting transversely to the direction in which the carrier is movable relative to the sled/base. Preferably, the form fit is produced in a direction making an angle with the direction of displacement between the carrier and the sled/base of more than 50°, particularly more than 60°, particularly more than 70°, particularly more than 80°, most particularly preferably 90°. Alternatively or additionally, a force locking may also be provided.

In one preferred embodiment, a sensor is present for detecting the end of the screwing process, whose signal can be received by a control device in order to achieve a securing of the holder to the sled. In this way, the introducing of the ground drilling device can be controlled for the most part automatically. Once the end of the screwing process has been detected by means of the sensor, a signal which the sensor provides to the control device can tell the control device that a securing can be carried out once more. In particular, the carrier can again be secured to the sled/base—insofar as a carrier is present.

The term "control device" in the sense of the specification encompasses an embodiment of a control system by means of which a directional influencing of the ground drilling device is possible in operation, i.e., during the making or at the starting or stopping of an earth borehole. The control device in particular may be electrical or electronic. Data and/or parameters entered by an attendant to perform the drilling can be used by the control device as input for the operation of the ground drilling device—optionally transformed and/or processed into electrical signals. The ground drilling device can thus be operated or controlled by means of a data entry, particularly a parameter, possibly transformed into an electrical signal.

By a "parameter" in the sense of the specification is meant a data entry with which a directional influencing of the operation of the ground drilling device is possible. The parameter may be relayed as an input signal to the control device, by means of which the control device controls the operation of the ground drilling device. A parameter may, for example, bring about a starting of the drilling with the ground drilling device or a stopping of a drilling being carried out with the ground drilling device.

In one preferred embodiment, the sensor may be an end switch, a proximity switch, a position switch, or the like. In one preferred embodiment, the holder is secured to the sled/base automatically or semiautomatically by means of a signal of a sensor. The sensor can detect the position of the holder and/or any carrier which is present. Alternatively or additionally, a pressure sensor may be provided, which detects a pressure rise in the hydraulic rotation drive for the holder when the thread is in the closed position or has reached an end stop.

In one preferred embodiment, an input device is provided, which produces a signal that can be received by a control device in order to accomplish a securing of the driving means on the sled/base. This creates the possibility of an attendant securing the holder on the sled/base by hand. An attendant will watch over the process of adding or removing of the last rod section on the drill string.

The term "input device" in the sense of the specification encompasses any electrical or electronic device which is suited to transforming a data entry by an attendant into an electrical signal. The electrical signal may be relayed to the control device with no further processing or by way of an intervening circuitry for processing of the signal, particularly a processing in one or more circuits, such as an amplifier, in order to be used as input or as an input signal of the control device. The input device can be understood as being an interface between an attendant and the control device. The input device may be in particular a keyboard, a joystick, a microphone, a push button, or the like.

The invention also creates a method for drilling in soil by means of a drill string, wherein a sled which is movable in translation is used for the pulling and/or pushing of the drill string. On the sled there is arranged a holder, with which a rod section can be screwed onto or unscrewed from a drill string. The holder is moved in translation relative to the sled in order to compensate for a change in the position of the holder caused by the screwing process.

The invention is being described in regard to two aspects, relating to a ground drilling device and a method for drilling in the soil. The remarks on the individual aspects complement each other, so that the remarks for the ground drilling device are also to be understood as remarks describing the method and vice versa. With the description of the ground drilling device, actions in regard to the method or method steps concerning the method are also disclosed, and vice versa.

In the sense of the specification, the indication of a numerical value, particularly an angle, encompasses not only the actual numerical value, but also a range about the specific numerical value which may be +/−15%, preferably +/−10%, of the indicated numerical value—in order to allow for fabrication tolerances, in particular.

The preceding remarks, just as the following description of exemplary embodiments, do not constitute any abandonment of particular embodiments or features.

The invention shall now be explained more closely with the aid of an exemplary embodiment presented in the drawing.

Figure 2:
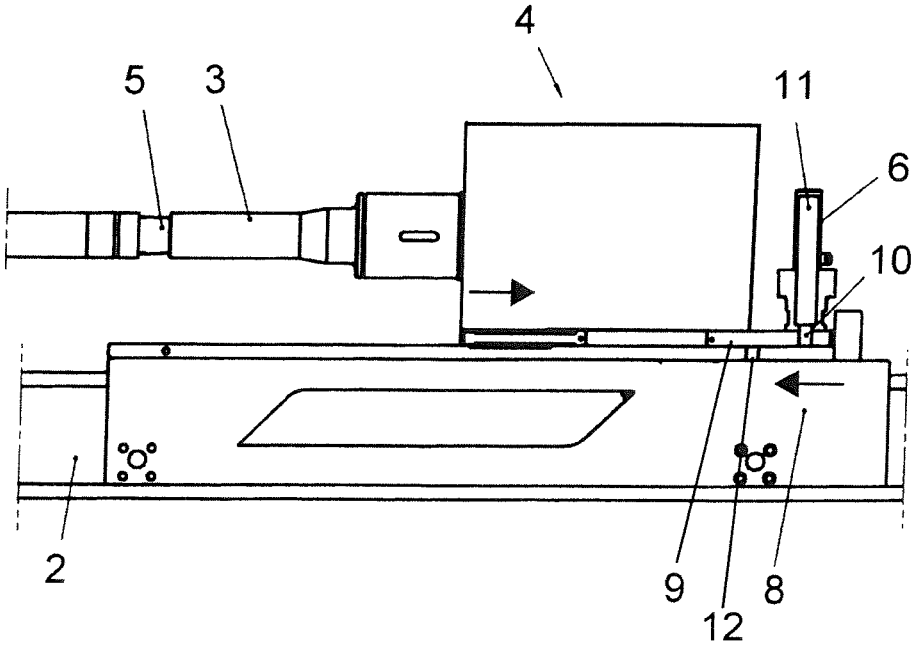
Figure 3:
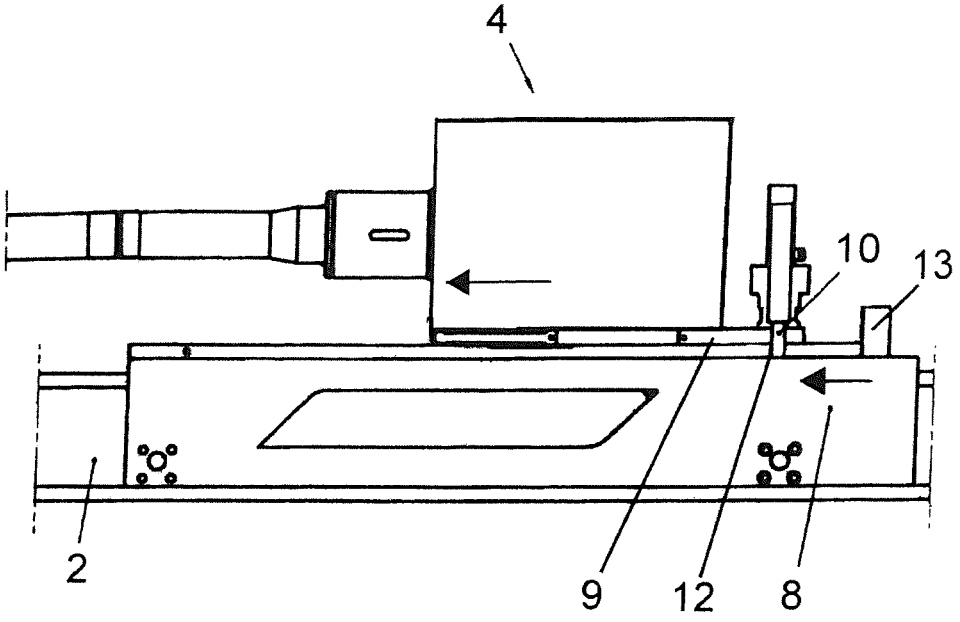

The drawings show:

FIG. 1 a side view of a ground drilling device in schematic representation;

FIG. 2 a sled of a ground drilling device before screwing of a rod section onto an already introduced drill string; and FIG. 3 a sled of a ground drilling device after screwing a new rod section onto the already introduced drill string.

FIG. 1 shows in a schematic representation from the side a ground drilling device 1, which works by soil displacement. With the ground drilling device 1, a drill string comprising rod sections 5 can be introduced into the soil by translation as well as rotation. For this, a sled 4 can move back and forth on a drilling carriage 2. The drilling carriage 2 defines, with the sled 4 or a holder 3, a drill string axis 7. The holder 3 is fashioned on the sled 4 in the form of an adapter or a connection by means of which a newly attached rod section 5 can be connected to the already introduced drill string and then be introduced into the soil.

The rod sections 5 are screwed together. For this, corresponding interacting threads are provided at the ends on the rod sections 5. The holder 3 forms a form fit with the rod section 5 being connected to the already introduced drill string. The rod section 5 is screwed onto the introduced drill string and the holder 3 and then the sled 4 travels in the direction of the drill string axis 7 on the drilling carriage 2.

FIG. 2 shows in a schematic view the condition before the holder 3 is connected to the rod section 5. The sled 4 comprises the holder 3, which is firmly connected to it on a carrier 9. The holder 3 is secured to the carrier 9 in the direction of the drill string axis 7. The holder 3 can rotate, but not move by displacement relative to the carrier 9.

The holder 3 is movable relative to a base 8 of the sled 4, while the carrier 9 may be secured relative to the base 8. For this, a form fit is provided between a bolt 10 and a holder borehole 12. The bolt 10 is designed as a movable bolt on the carrier 9. The bolt 10 is part of a locking device 6. The bolt 10 can be extended and retracted by means of a hydraulic cylinder 11. In the position shown in FIG. 2, the sled 4 is in a rear position on the drilling carriage 2 and extended onto a rod section 5 being screwed onto a drill string already situated in the soil. The carrier 9 has been moved backward relative to the base 8, opposite the drilling direction. The carrier 9 is pulled forward on the base 8 by the subsequent screwing of the holder 3 onto the new rod section 5 and the screwing of the new rod section 5 onto a drill string already located in the soil, not shown here. During the screwing process, the bolt 10 is in the retracted condition, as shown in FIG. 2.

When both threads of the new rod section 5 have been completely screwed on, i.e., both the front thread to the already introduced drill string and the rear thread to the holder 3, the carrier 9 is in a forward position, as shown in FIG. 3. The bolt 10 in this position of the carrier 9 relative to the base 8 can be retracted into the holder borehole 12 of the base 8 and now prevents a relative movement between base 8 and carrier 9. In this constellation, the drilling process is now continued at once; the sled 4 can be moved as a whole, so that the carrier 9 and the base 8 can be moved together. A travel of the sled 4 or the base 8 until the carrier 9 strikes against the end stop 13 can be avoided. Once the new rod section 5 has been introduced into the soil with the already introduced drill string, the bolt 10 can be retracted and the carrier 9 can move back with the holder 3 and the process of connecting a new rod section 5 to the introduced drill string can begin again.

The invention claimed is:

1. Ground drilling device for drilling in soil by means of a drill string, wherein the ground drilling device comprises a drilling carriage and a sled movable in translation on the drilling carriage and on the sled there is arranged a holder a) for the screwed connection of a rod section to the drill string or b) for the screwed detachment of a rod section from the drill string, wherein a carrier supporting the holder is movably arranged on the sled and is configured for selective securing relative to the sled to allow the holder to move in translation relative to the sled in order to compensate for a change in the position of the holder caused by the screwing process when the carrier is unsecured.

2. Ground drilling device according to claim 1, wherein the carrier supporting the holder is configured for securing to the sled when a force is applied to the sled to drive the drill string.

3. Ground drilling device according to claim 2, wherein the carrier is configured to be secured on the sled by means of a bolt.

4. Ground drilling device according to claim 2, wherein the carrier is configured to be secured on the sled by means of a hydraulically activated bolt.

5. Ground drilling device according to claim 1, further comprising a sensor for detecting the end of the screwing process, and providing a signal for receipt by a control device in order to achieve a securing of the holder to the sled.

6. Ground drilling device according to claim 5, wherein the sensor may be configured as one of an end switch, a proximity switch, or a position switch.

7. Ground drilling device according to claim 1, further comprising an input device which produces a signal that can be received by a control device in order to accomplish a securing of the holder on the sled.

8. Method for drilling in soil by means of a drill string, comprising:

providing a sled which is movable in translation for the pulling and/or pushing of the drill string on a drilling carriage, providing a carrier, movably arranged on the sled, supporting a holder with which a rod section can be screwed onto or unscrewed from a drill string, wherein the carrier supporting the holder is configured for selective securing relative to the sled to allow the holder to move in translation relative to the sled in order to compensate for a change in the position of the holder caused by the screwing process when the carrier is unsecured.

9. Method according to claim 8, further comprising providing input device which can be activated by means of an attendant, and wherein the holder is secured to the sled by means of an entry using the input device.

10. Method according to claim 8, wherein the holder is secured to the sled responsive to detection of a signal of a sensor.

11. Ground drilling device for drilling in soil by means of a drill string, wherein the ground drilling device comprises a drilling carriage and a sled movable in translation on the drilling carriage and on the sled there is arranged a holder a) for the screwed connection of a rod section to the drill string or b) for the screwed detachment of a rod section from the drill string, wherein a carrier supporting the holder is movably arranged on the sled and the holder is configured to move in translation relative to the sled in order to compensate for a change in the position of the holder caused by the screwing process, and wherein the carrier is configured to be secured on the sled by means of a bolt.

12. Ground drilling device according to claim 11, wherein the carrier is configured for selective securing relative to the sled to allow the holder to move in translation relative to the sled in order to compensate for a change in the position of the holder caused by the screwing process when the carrier is unsecured.

13. Ground drilling device according to claim 11, further comprising a sensor for detecting the end of the screwing process, and providing a signal for receipt by a control device in order to achieve a securing of the holder to the sled.

14. Ground drilling device according to claim 13, wherein the sensor may be configured as one of an end switch, a proximity switch, or a position switch.

15. Ground drilling device according to claim 11, further comprising an input device which produces a signal that can be received by a control device in order to accomplish a securing of the holder on the sled.

16. Ground drilling device according to claim 11, wherein the bolt comprises a hydraulically activated bolt.

* * * * *